US007690379B2

(12) United States Patent
Gossweiler

(10) Patent No.: US 7,690,379 B2
(45) Date of Patent: Apr. 6, 2010

(54) PRESSURE INDICATOR FOR POSITIVE PRESSURE PROTECTION MASKS

(75) Inventor: Otto Gossweiler, Effretikon (CH)

(73) Assignee: Branch, Banking and Trust Company, McLean, VA (US)

( * ) Notice: Subject to any disclaimer, the term of this patent is extended or adjusted under 35 U.S.C. 154(b) by 767 days.

(21) Appl. No.: 10/856,775

(22) Filed: Jun. 1, 2004

(65) Prior Publication Data

US 2005/0263155 A1 Dec. 1, 2005

(51) Int. Cl.
*A62B 17/04* (2006.01)

(52) U.S. Cl. ..... 128/205.23

(58) Field of Classification Search ..... 128/205.23, 128/201.28, 202.22, 203.11, 203.27, 204.18, 128/204.21, 204.22, 204.23, 204.29, 205.24
See application file for complete search history.

(56) References Cited

U.S. PATENT DOCUMENTS

| | | | | |
|---|---|---|---|---|
| 865,996 | A | 9/1907 | Catt | |
| 1,105,127 | A | 7/1914 | Drager | |
| 1,169,996 | A | 2/1916 | Prindle | |
| 3,018,776 | A | 1/1962 | Saitta | |
| 3,044,464 | A | 7/1962 | Gray | |
| 3,715,032 | A | 2/1973 | Nicko | |
| 3,731,717 | A | 5/1973 | Potash | |
| 3,852,196 | A | 12/1974 | Szpur | |
| 3,990,439 | A | 11/1976 | Klinger | |
| 4,243,029 | A | 1/1981 | Apple | |
| 4,257,415 | A | 3/1981 | Rubin | |
| 4,384,576 | A | 5/1983 | Farmer | |
| 4,402,316 | A | 9/1983 | Gadberry | |
| 4,433,684 | A | 2/1984 | Sarnoff | |
| 4,493,614 | A | 1/1985 | Chu | |
| 4,513,741 | A | 4/1985 | Demi | |
| 4,529,514 | A | 7/1985 | Gruett | |
| 4,574,799 | A | 3/1986 | Warnke | |
| 4,682,993 | A | 7/1987 | Todd | |
| 4,823,785 | A | 4/1989 | Mancosu | |
| 4,827,964 | A * | 5/1989 | Guido et al. | 137/81.1 |
| 4,841,963 | A | 6/1989 | Vandeputte | |
| 4,915,106 | A | 4/1990 | Aulgur | |
| 4,924,861 | A | 5/1990 | Kiske | |
| 4,936,298 | A | 6/1990 | Nishina | |
| 4,961,420 | A | 10/1990 | Cappa | |

(Continued)

FOREIGN PATENT DOCUMENTS

| | | |
|---|---|---|
| DE | 4241033 A1 | 6/1994 |

(Continued)

*Primary Examiner*—Steven O Douglas
(74) *Attorney, Agent, or Firm*—Duane Morris LLP

(57) ABSTRACT

A pressure indicator for positive pressure protection masks, including powered air purifying respirators (PAPRs) that monitors and determines relative air pressure between the internal space of a protection mask and the ambient environment to alert users of negative or threshold level air pressure, and in turn, to ensure safe operation of the protection masks. The pressure indicator, which is incorporated in the mask, alerts users when the air pressure in the mask reaches a critical level by transmitting optical signals, auditory signals, vibrational signals or a combination thereof that are detectable by the user. The optical signals are projected into the user's line of vision either directly or through a head-up display. The pressure indicator may cause the signal to indicate a safe and danger mode, or may cause the signal to indicate only during a danger mode.

39 Claims, 1 Drawing Sheet

U.S. PATENT DOCUMENTS

| | | | | | |
|---|---|---|---|---|---|
| 4,971,051 | A | | 11/1990 | Toffolon | |
| 5,036,846 | A | | 8/1991 | Aulgur | |
| 5,065,745 | A | | 11/1991 | Meier | |
| 5,209,226 | A | | 5/1993 | Goodley | |
| 5,235,972 | A | | 8/1993 | Strong | |
| 5,427,091 | A | | 6/1995 | Phillips | |
| 5,503,147 | A | | 4/1996 | Bertheau | |
| 5,684,253 | A | * | 11/1997 | Bonne et al. | 73/706 |
| 5,690,102 | A | | 11/1997 | Bertheau | |
| 5,914,037 | A | | 6/1999 | Yen | |
| 6,039,045 | A | | 3/2000 | Bertheau | |
| 6,076,409 | A | * | 6/2000 | Bang | 73/756 |
| 6,155,258 | A | | 12/2000 | Voege | |
| 6,214,074 | B1 | | 4/2001 | Silviera | |
| 6,269,811 | B1 | | 8/2001 | Duff | |
| 6,325,116 | B1 | | 12/2001 | Savage | |
| 6,615,828 | B1 | * | 9/2003 | Petherbridge | 128/200.28 |
| 6,796,304 | B2 | | 9/2004 | Odell | |
| 6,823,867 | B2 | | 11/2004 | Avery | |
| 6,834,650 | B1 | | 12/2004 | Fini | |
| 6,837,239 | B2 | * | 1/2005 | Beizndtsson et al. | 128/201.25 |
| 7,101,412 | B2 | | 9/2006 | Gossweiler | |
| 2003/0005932 | A1 | | 1/2003 | Rydgren | |
| 2005/0051169 | A1 | | 3/2005 | Gossweiler | |
| 2005/0103343 | A1 | * | 5/2005 | Gosweiler | 128/206.12 |
| 2005/0126572 | A1 | | 6/2005 | Gossweiler | |
| 2006/0048782 | A1 | | 3/2006 | Gossweiler | |

FOREIGN PATENT DOCUMENTS

| | | | |
|---|---|---|---|
| WO | 2005035365 | A2 | 4/2005 |
| WO | 2005055912 | A2 | 6/2005 |
| WO | 2005060374 | A2 | 7/2005 |
| WO | 2005061076 | A1 | 7/2005 |
| WO | 2005118072 | A1 | 12/2005 |
| WO | 2006028467 | A2 | 3/2006 |

* cited by examiner

PRESSURE INDICATOR FOR POSITIVE PRESSURE PROTECTION MASKS

BACKGROUND OF THE INVENTION

1. Field of the Invention

The present invention relates to a pressure indicator for positive pressure protection masks that enables positive safe operation of the protection masks.

2. Description of Related Art

Respiratory devices, such as protection masks, also interchangeably referred to herein as gas masks or masks, are well known. Civilians, law enforcement, military personnel, fire fighters and other groups of individuals commonly referred to as "responders" (hereinafter referred to as "users") wear masks for protection from an environment containing harmful and possibly fatal air-born toxins or any other such hazardous material. Such toxins and materials are hazardous to respiratory systems and generally take the form of harmful gases, vapors, and particulate matter. The respiratory hazards may also include various agents, such as nuclear, biological and chemical (NBC) agents, which may be in the form of particulates, vapors or aerosols.

One type of breathing apparatus, known as a Powered Air Purifying Respirator (PAPR) (also referred to herein interchangeably as "PAPR protection system"), is a fan-forced positive pressure breathing apparatus. PAPR protection systems are used in environments where the ambient air is relatively oxygen-rich and where filtering elements are effective in removing all contaminants from the ambient air before the ambient air enters the gas mask. PAPR protection systems typically include a gas mask, a filtering element to remove contaminants from ambient air, a blowing element, such as, a fan, and a power source to provide operational power to the blowing element. The fan or blowing element continously supplies filtered air to the gas mask. The filtered air replenishes the internal space of the mask, and the exhaled air, also known as spent air, is continually ejected.

Under certain circumstances, such as heavy workload or extreme body movement, for instance, protection masks can create openings (i.e., also known generally as "leaks") by not completely and seamlessly fitting to the contours of the user's face, and thus, forming an imperfect seal. The openings allow unfiltered, ambient air directly into the internal space of the mask, which may pose serious and even fatal health risks to the user if the ambient air contains harmful toxins or other such hazardous material. PAPR protection systems help reduce health risks caused by masks prone to or having leaks by creating a pressurized environment in the internal space of the mask (also interchangeably referred to as an "overpressurized environment"). In particular, because of the positive pressure gradient between the internal space of the mask and the ambient environment, the internal air pressure caused by the powered circulation of filtered air prevents the unfiltered, ambient air from entering the mask.

Although PAPR protection systems have reduced the danger of allowing unfiltered, ambient air into the internal space of the mask, and in turn, have reduced the danger of inhaling and contacting unfiltered, ambient air by the user, PAPR protection systems do not completely eliminate health risks. In some cases, PAPR protection systems fail to operate properly, and the health risks increase accordingly. Typically, when the PAPR protection system fails to operate, the internal space of the mask depressurizes, i.e., the overpressurized environment is lost. There are numerous instances in which the PAPR protection system may fail to provide a safe environment for the user. For instance, a kinked air supply hose, an obstructed air-purifying filter, a depleted blower battery, or an excessive demand for filtered air by the user may compromise the powered airflow caused by the PAPR protection systems, reducing the air pressure in the internal space of the mask. In each of these examples, the compromised PAPR protection system reduces positive pressure in the internal space of the mask, and thus, allows ambient air to enter the internal space, in the event that openings (i.e., leaks between the user's facial contours and the mask) were present.

The effectiveness of the PAPR protection system, which is typically measured in the level of safety provided to users, is directly correlated with the ability of the PAPR protection system to provide filtered air to the user while preventing unfiltered, ambient air from entering the internal space of the mask. Thus, in the event the safety of PAPR protection system is compromised, i.e., unfiltered, ambient air enters the internal space of the mask, users have a limited amount of time to exit or escape the environment having unfiltered, ambient air containing toxins and other such hazardous material (generally known as the "hot zone"). The present technology only includes devices that sense the volume of air in the mask, as opposed to the air pressure in the mask. Unfortunately, such technology provides an unreliable and indirect measure of whether the protection mask is safe. Presently, there is no reliable mechanism for the user to determine whether the PAPR protection system is functioning properly, and in turn, there is no mechanism for the user to determine whether the PAPR protection system is safe. Specifically, there is no mechanism for the user to determine whether the PAPR protection system has a positive air pressure within the internal space of the mask.

There is a need for a PAPR mask that provides users of the mask with information and feedback regarding the level of filtered air flow to the internal space of the mask. In particular, there is a need for a pressure indicator system, which measures the air pressure in the internal space of the mask and alerts users as to whether there is positive pressure in the mask and the actual value of the pressure gradient. Moreover, there is a further need for a pressure indicator system associated with the PAPR mask that informs the user whether the air entering the internal space of the mask is safe, i.e., whether filtered air rather than ambient air is filling the internal space of the mask.

SUMMARY OF THE INVENTION

Aspects of the present invention provide a pressure indicator system for positive pressure masks, wherein the pressure indicating system informs and alerts the user as to whether the protection mask is operating under positive pressure, and in turn, is operating safely. The pressure indicator system is incorporated within the PAPR mask and detects the air pressure level therein. The pressure indicator measures the relative pressure of the mask based on the air pressure of the ambient environment and the air pressure of the internal space of the mask. The pressure indicator displays a signal, which may be optical, auditory, or vibrational, for example, easily detectable by the user which indicates whether the pressure in the internal space of the mask is positive or negative. In one embodiment, when the relative air pressure of the internal space of the mask reaches a predetermined threshold, which may be zero or any value greater than zero, the pressure indicator activates an optical diode, which emits a light that is projected into the field of vision of the user.

Another aspect of the present invention is to provide a pressure indicator system incorporated with a positive pressure protection mask that provides accurate and exact pressure level readings to the user and that provides a detectable signal to the user if the pressure level within the mask reaches a negative or predetermined value.

Additional aspects, advantages, and novel features of the present invention will become more apparent from the following description.

DETAILED DESCRIPTION OF THE PRESENT INVENTION

The present invention includes a pressure indicator system (referred interchangeably herein as a "pressure sensor," "pressure indicator," "sensor," or "system") for a positive pressure protection mask, such as, for example, a PAPR protection system. The present invention satisfies the unmet needs in the art by providing users with feedback and an alert during use of the mask about the safety of the protection mask, specifically whether the air pressure inside the mask is positive. Moreover, the present invention provides a pressure indicator system that detects and measures the air pressure in the internal space of the mask and subsequently informs the user of the measured air pressure.

Figure 1:
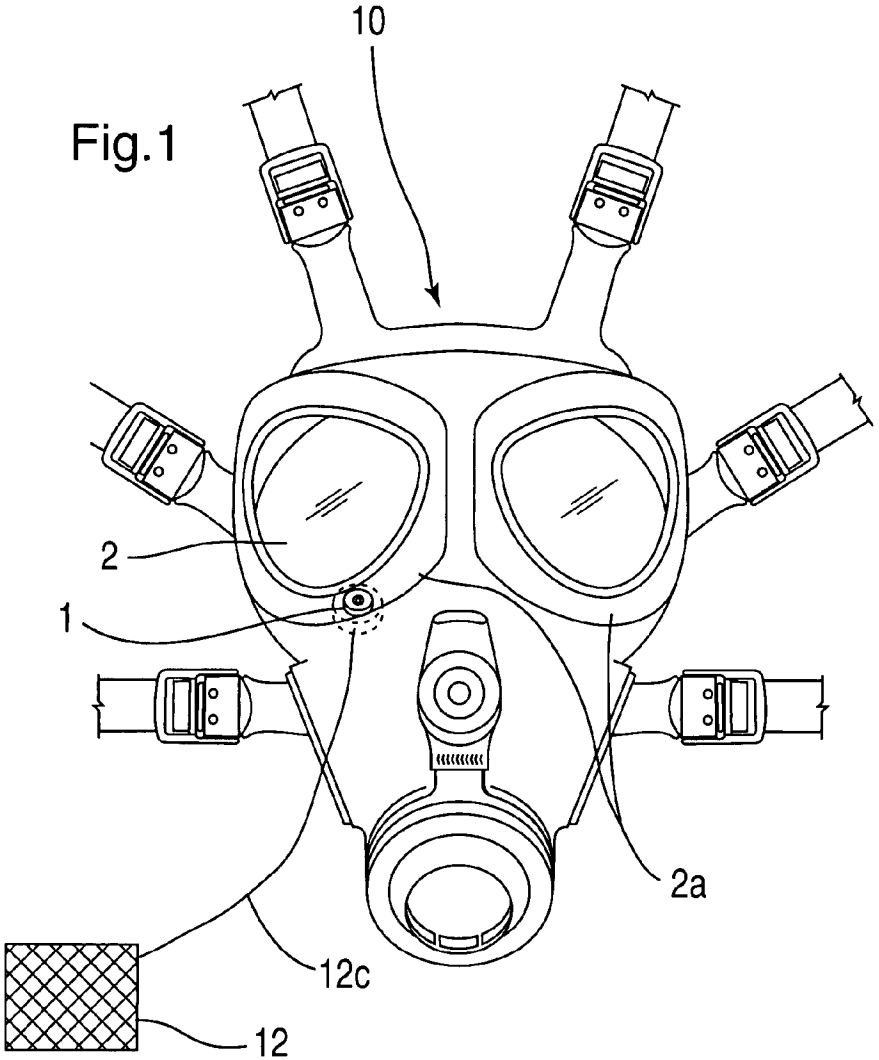
FIG. 1 is a front view of a protection mask having a pressure indicator system disposed within the protection mask, in accordance with one embodiment of the present invention.

In FIG. 1, in one embodiment of the invention, the mask 10 is equipped with lenses 2, through which the user sees from inside the mask 10. In this embodiment, at least one pressure indicator 1 is disposed at the base 2*a* of a corresponding lens 2. It should be noted that the pressure indicator 1 may be disposed at any location within the mask 10 so long as the pressure indicator 1 is able to measure the ambient air pressure outside of the mask 10 and the internal air pressure within the mask 10. Generally, the pressure indicator 1 is disposed at the base 2*a* of lens 2 corresponding to the dominant hand of the anticipated user, e.g., a right-handed user would have a pressure indicator 1 installed at the base 2*a* of the right lens 2. The choice of the lens 2 on which the pressure indicator 1 is disposed may vary, however. In one variation, a pressure indicator 1 is disposed at the base 2*a* of each lens 2.

Figure 2:
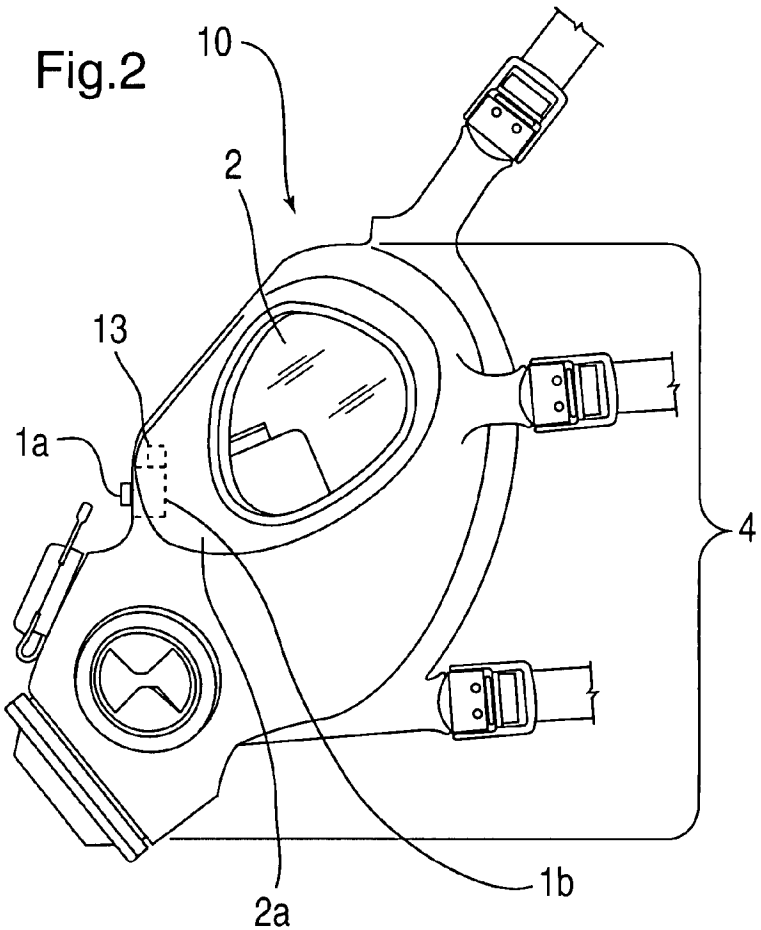
FIG. 2 is a side view of the protection mask shown in FIG. 1.

In FIG. 2, in another embodiment of the invention, the pressure indicator 1 is securely disposed at the base 2*a* of a first lens 2. It is important to note that the pressure indicator 1 of the present invention may be fitted to any type of protection mask. The base 2*a* of the first lens 2 includes an aperture, which corresponds to the size of the pressure indicator 1, allowing the pressure indicator 1 to extend from an outer surface of a facepiece 4 of the mask 10 to the inner surface of the facepiece 4 of the mask 10. The pressure indicator 1 includes a vent 1*a* to ambient and a vent 1*b* to the inside of the facepiece 4. A first end of the vent 1*a* to ambient is disposed proximal to an outer surface of the mask 10, and a second end of the vent to ambient 1*a* is exposed to ambient air. In addition, a first end of the vent 1*b* to the inside of the facepiece 4 is disposed proximal to an inner surface of the mask 10, and a second end of the vent 1*b* to the inside of the facepiece 4 is exposed to filtered air in the internal space of the mask 10. The first end of the vent 1*a* to ambient and the first end of the vent 1*b* to the inside are in communication with each other through the aperture in the base 2*a* of the lens 2.

It should be noted that in other embodiments of the present invention, the pressure indicator 1 is disposed at any position in the mask 10. A condition with respect to the disposition of the pressure indicator 1 is that the pressure indicator 1 is disposed wherein the vent to ambient 1*a* is exposed to ambient air and the vent to the inside 1*b* is exposed to the internal air pressure of the mask 10.

The pressure indicator 1 detects the pressure of the internal space of the mask 10. In particular, the pressure indicator 1 measures whether pressure of the filtered air generated by the PAPR protection system, for example, is positive relative to the air pressure of ambient air. Thus, the pressure indicator 1 may use a diaphragm to sense the pressure differential between ambient and internal mask pressure.

The pressure indicator 1 may be of any type of pressure indicator known in the art. For example, the pressure indicator 1 may be a Bourdon tube-type sensor or a spring-loaded diaphragm. In another variation, the pressure indicator 1 may be a bellows-type or a tubular-type pressure sensor. It should be noted that the pressure indicator 1 may be one of any known or future developed pressure indicator that is capable of detecting relative or absolute pressure. Regardless of which pressure indicator type is ultimately used, it should be understood that the sensor of the pressure indicator 1 is mounted on the inner surface of the mask 10.

In one embodiment of the present invention, the pressure-sensor indicator is a diaphragm-type sensor that is housed in a dual-chamber housing. The diaphragm in is part of the mask housing to seal off the outside air from the inside air volume. The diaphragm can be made from ethylene propylene diene monomer (EPDM) or any other suitable material. The diaphragm is supported or backed up, for instance, by an expandable or spring-like metal disc, which is attached to the dividing partition in the sensor housing. The metal disc closes two metal contacts when the sensor experiences an adjustment in the pressure setting. Sensors of this design are to be suited for nuclear, biological and chemical ("NBC") environment conditions.

In one embodiment of the present invention, the pressure indicator 1 causes an electrical contact to close at a predetermined pressure differential between ambient and internal air pressure. The pressure setting of the pressure indicator 1 must be set to a value above zero relative pressure in order to prevent dangerous conditions for the user. In one variation, the value is set to a value greater than zero, e.g., one, two or three. For example, by setting the pressure value a level above zero, the user has some degree of time before the pressure falls below zero and the environment becomes harmful. For example, if the pressure level is set at one, the user can note that the pressure level is dropping and is given a preset period of time (e.g., ten minutes) to escape to a safer environment.

In one variation, for example, a piezo resistive type sensor is used. The piezo resistive type sensor is combined with a digital readout which indicates the actual pressure inside the mask in mbars. Thus, if the pressure inside the mask is 1 mbar (positive pressure), for example, a pressure of 0 mbar would be considered a safe value.

The pressure indicator 1 determines the low pressure condition in the mask 10 and informs the user through a signaling device 13. The signaling device 13 transmits optical, acoustical and/or vibrational signals, or any other types of signals known or later developed in the art. In one variation, the pressure indicator 1 includes an optical signal, such as a colored light or other light emitter, a commonly known light emitter being a light emitting diode, which is lit when the pressure inside the mask 10 is negative or meets the predetermined threshold value of the pressure indicator 1. For instance, a red light is emitted by the signaling device when the air pressure inside the mask 10 reaches a threshold level or a negative level. In another variation, the pressure indicator 1 includes multiple optical signals, each of which is color coded (e.g., green and red). In this embodiment, for example, when the pressure inside the mask 10 is positive, the optical signal lights a green light and when the pressure inside the mask 10 is negative the optical signal lights a red light. In one variation, the pressure mask has a pressure indicator 1, which is colored yellow, for instance, wherein the yellow light provide a caution to the user that pressure level is decreasing. This caution alert may signal the user when pressure is at some level above zero, such as one, two or three.

In another variation of the present invention, the optical signal is disposed inside the mask 10 wherein the light from the light diode is emitted to enter the user's line of vision. In yet another variation, the light source is reflected on the lens 2 of the mask 10 or on the full visor, providing a "head up display," which is generally known in the art.

In one more variation, a printed circuit board (PCB) of the pressure indicator 1 is extended over the housing diameter at the location of the light-emitting source in order to extend into the area of the lens 2 or the full visor of the mask 10. Hence, a portion of the PCB is extended outside of the sensor housing by, for example, 0.25 inches. At the tip of the PCB is a light emitting diode ("LED"). The LED is not necessarily based on the head up display and the corresponding reflection of light. Rather, the LED is typically in the line of sight of the mask user in this embodiment and this feature provides increased visibility in bright sunlight condition than the head up display.

The acoustical and vibrational signals function in a manner similar to the optical signals described above. Specifically, the acoustical and vibrational signals may send an alarm to the user only when the relative air pressure inside the mask 10 reaches a negative or threshold level. Alternatively in another variation, the acoustical and vibrational signals may transmit multiple signals, wherein a first signal indicates positive pressure and a second signal indicates negative (or threshold) pressure.

The pressure indicator 1 and the signaling device 13 are powered by a power device 12. In one variation of the present invention, the pressure indicator 1 and the signaling device 13 are powered by the blower battery of the PAPR. Thus, a conducting means 12*c* is connected from the battery to the pressure indicator 1. In one variation, the pressure indicator 1 is automatically activated when the blower is activated. In another variation, the pressure indicator 1 includes a switch that is manually manipulated to turn the pressure indicator 1 on and off. In another variation of the present invention, the pressure indicator 1 is powered using an independent small battery, solar cell, fuel cell, piezo electric device or other power device generally known or later developed in the art. In this variation, the sensor component of the pressure indicator 1, the vents 1*a* and 1*b*, and the power device 12, are integrated in a compact housing, which is vented to the ambient environment and to the internal space of the mask 10.

Another embodiment of the present invention makes use of the silicon-based piezo resistive sensor, which is integrated with an application specific integrated circuit (ASIC). The circuit displays a digital pressure reading in addition to a desired warning signal (e.g., light, sound, or vibration). This digital pressure-reading indicator is powered with electrical power from a small battery, solar cell, fuel cell, or combination thereof. A digital read-out portion of the digital pressure-reading indicator is disposed in the area of the lens 2 of the mask 10 or the full visor of the mask 10 in order to receive the attention of the mask user.

In yet another variation using the piezo-resistive sensor, the pressure signal can be transmitted to the blower motor control board via a glass fiber cable or via a wire antenna transmission device that does not require direct contact between the sensor PCB and the motor PCB. In one variation, a glass fiber cable is typically used when the signal transmission from the sensor to the blower will be an optical signal. This cable can be inside or outside the breathing hose. This signal is modulated in order to regulate the blower output according to the pressure requirement in the mask.

While there has been described what are at present considered to be preferred embodiments of the present invention, it will be understood that various modifications may be made thereto, and it is intended that the appended claims cover all such modifications as fall within the true spirit and scope of the invention. Other modifications will be apparent to those skilled in the art.

What is claimed is:

1. A pressure indicator for positive pressure protection masks, comprising:

a protection mask; and a pressure indicator incorporated into a body of the protection mask, including a first vent to an ambient environment and a second vent to an internal space of the mask in communication with the first vent, wherein the pressure indicator detects an internal air pressure within the mask, wherein the pressure indicator extends outwardly from an outer surface of the mask and inwardly from an inner surface of the mask; and a signaling device linked to the pressure indicator, wherein the signaling device emits a signal at a threshold internal air pressure.

2. The pressure indicator according to claim 1, wherein the pressure indicator detects the internal air pressure within the mask relative to an air pressure of an ambient environment outside of the mask.

3. The pressure indicator according to claim 2, wherein the pressure indicator indicates a negative pressure level.

4. The pressure indicator according to claim 2, wherein the pressure indicator indicates a positive pressure level and a negative pressure level.

5. The pressure indicator according to claim 1, wherein the first vent is exposed to the ambient environment outside of the mask and the second vent is exposed to the internal air pressure of the mask.

6. The pressure indicator according to claim 1, wherein the pressure indicator is disposed proximate a lens of the protection mask.

7. The pressure indicator according to claim 6, wherein the pressure indicator is disposed in a base of the lens.

8. The pressure indicator according to claim 6, wherein a pressure indicator is disposed in a base of each lens.

9. The pressure indicator according to claim 1, wherein the internal threshold pressure is greater than or equal to zero.

10. The pressure indicator according to claim 1, wherein the signaling device is selected from a group including at least one of optical, auditory and/or vibrational signals.

11. The pressure indicator according to claim 10, wherein the optical signal is emitted by a light diode.

12. The pressure indicator according to claim 10, wherein the light diode is color coded to correspond to positive and negative air pressure values.

13. The pressure indicator according to claim 12, wherein the light diode is colored red for a negative pressure value and green for a positive pressure value.

14. The pressure indicator according to claim 12, wherein the light diode is colored red for a negative pressure value, green for a positive pressure value greater than or equal to approximately 2 mbars, and yellow for a pressure value greater than and equal to approximately zero mbars and less than approximately 2 mbars.

15. The pressure indicator according to claim 10, wherein the optical signal is emitted directly into a field of vision of the user.

16. The pressure indicator according to claim 10, wherein the optical signal is emitted to a visor of the mask, providing a head up display.

17. The pressure indicator according to claim 1, wherein the positive pressure protection mask is a powered air purifying respirator (PAPR) mask.

18. The pressure indicator according to claim 1, wherein the pressure indicator measures and displays an actual pressure value.

19. The pressure indicator according to claim 18, wherein the pressure indicator further comprises:

a digital monitor that displays the actual pressure value.

20. The pressure indicator according to claim 1, wherein the pressure indicator is selected from a group including a Bourdon tube indicator, a spring loaded sensor, a bellows indicator and a tubular indicator.

21. The pressure indicator according to claim 1, wherein the pressure indicator is powered by a power device.

22. The pressure indicator according to claim 21, wherein the power device is one selected from a group including a battery, fuel cell, solar cell, and piezo electric device.

23. The pressure indicator according to claim 21, wherein the power device is integrated with the pressure indicator.

24. The pressure indicator according to claim 21, wherein the power device also powers a blower.

25. The pressure indicator according to claim 1, wherein the pressure indicator is a diaphragm-type sensor having at least one diaphragm.

26. The pressure indicator according to claim 25, wherein the diaphragm-type sensor is housed in a dual chamber.

27. The pressure indicator according to claim 25, wherein the at least one diaphragm is composed of EPDM.

28. The pressure indicator according to claim 25, wherein the at least one diaphragm is supported by an expandable disc which is attached at a dividing partition of the sensor.

29. The pressure indicator according to claim 1, wherein the pressure indicator is a piezo resistive type sensor.

30. The pressure indicator according to claim 29, wherein the piezo resistive type sensor further comprises:

a digital readout that indicates the actual pressure determined by the sensor.

31. The pressure indicator according to claim 1, wherein the pressure indicator extending outside the mask further comprises:

an LED optical signaling device.

32. The pressure indicator according to claim 1, wherein the pressure indicator includes a sensor mounted on the inner surface of the protection mask.

33. A pressure indicator, comprising:

a pressure indicator, incorporated into a body of a protection mask, including a first vent to an ambient environment and a second vent to an internal space of the mask in communication with the first vent, wherein the pressure indicator detects an internal air pressure within the mask, wherein the pressure indicator extends outwardly from an outer surface of the protection mask and a second end extends inwardly from an inner surface of the protection mask; and a signaling device wherein the signaling device emits a signal at a threshold internal air pressure.

34. The pressure indicator of claim 33, wherein the pressure indicator detects the internal air pressure within the mask relative to an air pressure of an ambient environment outside of the mask.

35. The pressure indicator of claim 33, wherein the pressure indicator further comprises:

a vent to an ambient environment outside of the protection mask; and a vent to an internal space of the protection mask communicatively coupled to the vent to ambient air.

36. The pressure indicator of claim 33, further comprising:

a signaling device linked to the pressure indicator for emitting a signal at a threshold internal air pressure, wherein the signaling device is selected from a group including at least one of optical, auditory and/or vibrational signals and is positioned either on the inner surface or the outer surface of the protection mask.

37. The pressure indicator according to claim 33, wherein the pressure indicator further comprises:

a digital monitor that displays the actual pressure value.

38. The pressure indicator according to claim 33, wherein the pressure indicator is selected from a group including a Bourdon tube indicator, a spring loaded sensor, a bellows indicator and a tubular indicator.

39. The pressure indicator according to claim 33, wherein the pressure indicator includes a sensor selected from the group consisting of a diaphragm-type sensor having at least one diaphragm and a piezo resistive type sensor.

* * * * *